US011004627B2

(12) United States Patent
Okutani

(10) Patent No.: US 11,004,627 B2
(45) Date of Patent: May 11, 2021

(54) REACTION FORCE GENERATING MEMBER AND KEY SWITCH DEVICE

(71) Applicant: FUJITSU COMPONENT LIMITED, Tokyo (JP)

(72) Inventor: Shinnosuke Okutani, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/886,253

(22) Filed: Feb. 1, 2018

(65) Prior Publication Data

US 2018/0286604 A1 Oct. 4, 2018

(30) Foreign Application Priority Data

Mar. 30, 2017 (JP) ..... JP2017-069263

(51) Int. Cl.

| | |
|---|---|
| ***H01H 13/14*** | (2006.01) |
| ***H01H 13/20*** | (2006.01) |
| ***H01H 13/705*** | (2006.01) |
| ***H01H 13/85*** | (2006.01) |
| ***H01H 3/12*** | (2006.01) |

(52) U.S. Cl.

CPC ..... *H01H 13/14* (2013.01); *H01H 3/122* (2013.01); *H01H 13/20* (2013.01); *H01H 13/705* (2013.01); *H01H 13/85* (2013.01); *H01H 2215/004* (2013.01); *H01H 2215/006* (2013.01); *H01H 2215/02* (2013.01); *H01H 2217/004* (2013.01); *H01H 2221/05* (2013.01); *H01H 2227/022* (2013.01)

(58) Field of Classification Search

CPC ..... H01H 13/14; H01H 13/20; H01H 13/705; H01H 2215/004

USPC ..... 200/513, 516, 406, 344

See application file for complete search history.

(56) References Cited

U.S. PATENT DOCUMENTS

| | | | | |
|---|---|---|---|---|
| 3,773,997 | A | 11/1973 | Evans et al. | |
| 3,849,611 | A | 11/1974 | Walker, Jr. | |
| 3,856,998 | A | 12/1974 | Sims, Jr. | |
| 4,515,999 | A | 5/1985 | Harper | |
| 4,584,444 | A | 4/1986 | Nagashima | |
| 4,604,509 | A * | 8/1986 | Clancy | H01H 13/702 200/513 |
| 4,755,645 | A | 7/1988 | Naoki et al. | |

(Continued)

FOREIGN PATENT DOCUMENTS

| | | | |
|---|---|---|---|
| CN | 1177133 | A | 3/1998 |
| CN | 1604251 | A | 4/2005 |

(Continued)

OTHER PUBLICATIONS

Office Action dated Mar. 30, 2018 in U.S. Appl. No. 15/610,771.

(Continued)

*Primary Examiner* — Edwin A. Leon
*Assistant Examiner* — Lheiren Mae A Caroc
(74) *Attorney, Agent, or Firm* — Staas & Halsey LLP

(57) ABSTRACT

A reaction force generating member includes: a first dome that gives a reaction force to an operation member according to the depression of the operation member; and a second dome that includes a hemispherical bowl part disposed inside the first dome, and a projection projecting downward from the center of the bowl part and depressing a switch disposed below the operation member.

8 Claims, 5 Drawing Sheets

(56) References Cited

U.S. PATENT DOCUMENTS

| | | | | |
|---|---|---|---|---|
| 5,203,448 | A | 4/1993 | Osada et al. | |
| 5,256,843 | A | 10/1993 | Chiba et al. | |
| 5,278,374 | A | 1/1994 | Takagi et al. | |
| 5,389,757 | A | 2/1995 | Souliere | |
| 5,401,926 | A | 3/1995 | Aoyama et al. | |
| 5,967,298 | A | 10/1999 | Watanabe et al. | |
| 6,153,844 | A | 11/2000 | Hyono et al. | |
| 6,649,821 | B2 | 11/2003 | Inoue | |
| 7,166,813 | B2 | 1/2007 | Soma et al. | |
| 7,217,893 | B1 | 5/2007 | Huang et al. | |
| 7,683,280 | B2 | 3/2010 | Hsu | |
| 7,952,043 | B2 | 5/2011 | Lin | |
| 9,741,507 | B2 | 8/2017 | Nishino et al. | |
| 2001/0011999 | A1 | 8/2001 | Mochizuki | |
| 2002/0065054 | A1 | 5/2002 | Humphreys et al. | |
| 2006/0000694 | A1 | 1/2006 | Nishino et al. | |
| 2006/0113178 | A1 | 6/2006 | Soma et al. | |
| 2009/0224948 | A1 | 9/2009 | Nishino et al. | |
| 2009/0277766 | A1 | 11/2009 | Fujitsuna | |
| 2010/0078301 | A1 | 4/2010 | Yeh | |
| 2011/0127152 | A1 | 6/2011 | Hu | |
| 2014/0339065 | A1* | 11/2014 | Ohtsuka | H01H 3/125 200/5 A |
| 2015/0170854 | A1 | 6/2015 | Nishino et al. | |
| 2015/0199023 | A1 | 7/2015 | Hu et al. | |
| 2018/0286604 | A1 | 10/2018 | Okutani | |

FOREIGN PATENT DOCUMENTS

| | | | |
|---|---|---|---|
| CN | 1716483 | A | 1/2006 |
| CN | 1747092 | A | 3/2006 |
| CN | 101297385 | A | 10/2008 |
| CN | 101770250 | A | 7/2010 |
| CN | 104715953 | A | 6/2015 |
| JP | 64-65732 | | 3/1989 |
| JP | 2-27622 | | 2/1990 |
| JP | 3-57114 | | 3/1991 |
| JP | 4-272625 | | 9/1992 |
| JP | 4-301331 | | 10/1992 |
| JP | 5-66832 | | 9/1993 |
| JP | 5-234460 | | 9/1993 |
| JP | 5-342944 | | 12/1993 |
| JP | 6-103851 | | 4/1994 |
| JP | 7-226123 | | 8/1995 |
| JP | 9-27235 | | 1/1997 |
| JP | 9-213165 | | 8/1997 |
| JP | 11-3628 | | 1/1999 |
| JP | 11-306908 | | 11/1999 |
| JP | 11-339590 | | 12/1999 |
| JP | 2000-235820 | | 8/2000 |
| JP | 2001-202849 | | 7/2001 |
| JP | 2004-139752 | | 5/2004 |
| JP | 2006-156170 | | 6/2006 |
| JP | 2009-211930 | | 9/2009 |
| JP | 2011-249282 | | 12/2011 |
| JP | 2011-253685 | | 12/2011 |
| JP | 2013-254615 | | 12/2013 |
| JP | 2015-133309 | | 7/2015 |
| TW | 200847211 | | 12/2008 |
| TW | M377636 | U1 | 4/2010 |
| TW | 201602862 | A | 1/2016 |
| WO | 2007/114631 | A2 | 10/2007 |

OTHER PUBLICATIONS

Office Action for U.S. Appl. No. 15/610,771, dated Jul. 3, 2017.
Office Action for U.S. Appl. No. 15/610,771, dated Dec. 11, 2017.
Chinese Office Action dated Mar. 29, 2017 in corresponding Chinese Patent Application No. 201410767031.X.
Chinese Office Action dated Sep. 14, 2017 in corresponding Chinese Patent Application No. 201410767031.X.
Japanese Office Action dated Jan. 23, 2018 in corresponding Japanese Patent Application No. 2014-138828.
Japanese Platform for Patent Information English abstract for Japanese Patent Publication No. 2006-156170, published Jun. 15, 2006.
Jun. 20, 2017 Notice of Allowance in U.S. Appl. No. 14/558,794 (now U.S. Pat. No. 9,741,507).
Japanese Platform for Patent Information English abstract for Japanese Patent Publication No. 64-65732, published Mar. 13, 1989.
Japanese Platform for Patent Information English abstract for Japanese Patent Publication No. 2015-133309, published Jul. 23, 2015.
Patent Abstracts of Japan, Publication No. 03-057114, published Mar. 12, 1991.
Patent Abstracts of Japan, Publication No. 04-272625, published Sep. 29, 1992.
Espacenet Bibliographic data, Publication No. JPH0566832 (U), published Sep. 3, 1993.
Patent Abstracts of Japan, Publication No. 05-234460, published Sep. 10, 1993.
Patent Abstracts of Japan, Publication No. 05-342944, published Dec. 24, 1993.
Patent Abstracts of Japan, Publication No. 06-103851, published Apr. 15, 1994.
Patent Abstracts of Japan, Publication No. 07-226123, published Aug. 22, 1995.
Patent Abstracts of Japan, Publication No. 09-027235, published Jan. 28, 1997.
Patent Abstracts of Japan, Publication No. 09-213165, published Aug. 15, 1997.
Patent Abstracts of Japan, Publication No. 11-003628, published Jan. 6, 1999.
Patent Abstracts of Japan, Publication No. 11-339590, published Dec. 10, 1999.
Patent Abstracts of Japan, Publication No. 2000-235820, published Aug. 29, 2000.
Patent Abstracts of Japan, Publication No. 2001-202849, published Jul. 27, 2001.
Patent Abstracts of Japan, Publication No. 2009-211930, published Sep. 17, 2009.
Patent Abstracts of Japan, Publication No. 2011-249282, published Dec. 8, 2011.
Patent Abstracts of Japan, Publication No. 2011-253685, published Dec. 15, 2011.
Patent Abstracts of Japan, Publication No. 2013-254615, published Dec. 19, 2013.
Sipo English Patent Abstract, Publication No. 1716483 A, Published Jan. 4, 2006.
Sipo English Patent Abstract, Publication No. 1177133 A, Published Mar. 25, 1998.
Espacenet English Abstract, Publication No. 1747092 A, Published Mar. 15, 2006.
Sipo English Patent Abstract, Publication No. 1604251 A, Published Apr. 6, 2005.
Chinese Office Action dated Jul. 20, 2016 in corresponding Chinese Patent Application No. 201410767031.X.
English translation of Japanese Reference No. 2006-079925, published Mar. 23, 2016 (Corresponding to Ref. BP).
J-PlatPat English Patent Abstract, Publication No. 2006-079925, Published Mar. 23, 2006.
Office Action for U.S. Appl. No. 14/558,794, dated Jan. 22, 2016.
Office Action for U.S. Appl. No. 14/558,794, dated Jun. 15, 2016.
Office Action for U.S. Appl. No. 14/558,794, dated Sep. 22, 2016.
Office Action for U.S. Appl. No. 14/558,794, dated Feb. 8, 2017.
Japanese Platform for Patent Information English abstract for Japanese Patent Publication No. 4-301331, published Oct. 23 1992.
U.S. Appl. No. 15/610,771, filed Jun. 1, 2017, Takeshi Nishino et al., Fujitsu Component Limited.
Japanese Platform for Patent Information English abstract for Japanese Patent Publication No. 2004-139752, dated May 13, 2004.
Chinese Office Action dated Jan. 25, 2019 in corresponding Chinese Patent Application No. 201710424845.7.
Espacenet English abstract for Chinese Patent Publication No. 101297385 A, published Oct. 29, 2008.

(56) References Cited

OTHER PUBLICATIONS

Espacenet English abstract for Taiwanese Patent Publication No. 200847211, published Dec. 1, 2008.
Espacenet English abstract for Taiwanese Patent Publication No. 201602862 A, published Jan. 16, 2016.
Espacenet English abstract for Taiwanese Utility Model No. M377636U1, published Apr. 1, 2010.
Espacenet English abstract for Chinese Patent Publication No. 101770250 A, published Jul. 7, 2010.
Taiwanese Office Action dated Sep. 13, 2018 in corresponding Taiwanese Patent Application No. 107103377.
Espacenet English abstract for Chinese Patent Publication No. 104715953 A, published Jun. 17, 2015.
Chinese Office Action dated Mar. 4, 2019 in corresponding Chinese Patent Application No. 201810202347.2.
Taiwanese Office Action dated Jun. 5, 2019 in corresponding Taiwanese Patent Application No. 107103377.
Taiwan Office Action dated Apr. 8, 2020 in Taiwan Patent Application No. 107103377.
U.S. Office Action dated Mar. 23, 2020 in U.S. Appl. No. 16/729,943.
U.S. Office Action dated Oct. 9, 2020 in U.S. Appl. No. 16/729,943.
Japanese Office Action dated Oct. 27, 2020 in Japanese Patent Application No. 2017-069263.
U.S. Office Action dated Sep. 2, 2020 in U.S. Appl. No. 16/513,046.
U.S. Notice of Allowance dated Jan. 26, 2021 in U.S. Appl. No. 16/513,046.

* cited by examiner

REACTION FORCE GENERATING MEMBER AND KEY SWITCH DEVICE

CROSS-REFERENCE TO RELATED APPLICATION

This application is based upon and claims the benefit of priority of the prior Japanese Patent Application No. 2017-069263 filed on Mar. 30, 2017, the entire contents of which are incorporated herein by reference.

FIELD

A certain aspect of the embodiments is related to a reaction force generating member and a key switch device.

BACKGROUND

Conventionally, there has been known a key switch device using a dome rubber arranged between a membrane sheet and a key top (see Patent Document 1; Japanese Laid-open Patent Publication No. 2015-133309). The dome rubber includes an outer dome that gives a reaction force according to elastic deformation to the key top, and an inner dome that depresses a contact of the membrane sheet.

In the key switch, the operation force increases until a load which acts on the outer dome of the dome rubber reaches a buckling load of the outer dome. When the load which acts on the outer dome reaches the buckling load of the outer dome, the operation force decreases gradually with the increase in a keystroke. Then, the contact is turned on in a process in which the operation force is decreasing. Therefore, an operator gets a feeling of a click by acquiring a peak (maximum) operation force by the buckling deformation of the outer dome. Since the contact is turned on in the process in which the operation force is decreasing, an operation feeling sufficiently corresponds to a contact depression operation, and hence the operability of the key switch device is improved.

SUMMARY

According to an aspect of the present invention, there is provided a reaction force generating member including: a first dome that gives a reaction force to an operation member according to the depression of the operation member; and a second dome that includes a hemispherical bowl part disposed inside the first dome, and a projection projecting downward from the center of the bowl part and depressing a switch disposed below the operation member.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the key switch device of the Patent Document 1, since the key top is tilted when a corner of the key top is depressed, the load is not applied evenly left and right to the outer dome and the inner dome. Therefore, there is a possibility that the inner dome causes the buckling deformation. When the inner dome causes the buckling deformation, a desired load characteristic of the dome rubber is not obtained and a deviation occurs between the operation feeling and the contact depression operation, thereby causing an uncomfortable feeling to an operator.

A description will now be given of embodiments of the present invention with reference to the drawings.

Figure 1A:
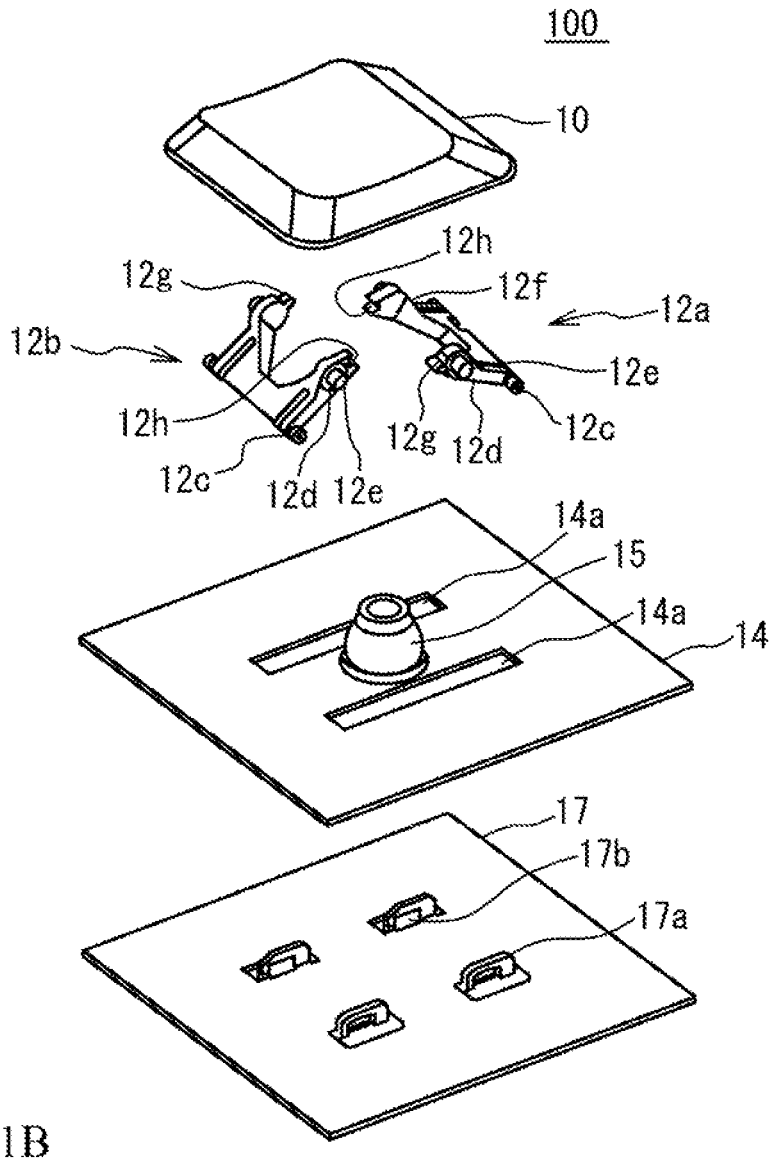
FIG. 1A is an exploded perspective view illustrating a key switch device according to a present embodiment.
Figure 1B:
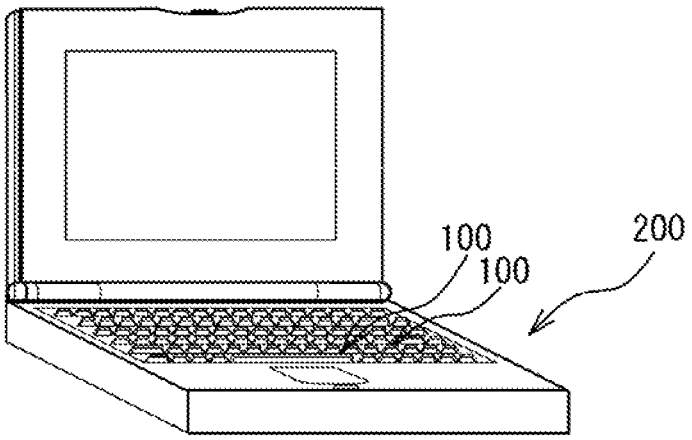
FIG. 1B is a diagram illustrating a computer including a keyboard on which a plurality of key switch devices are arranged.
Figure 2A:
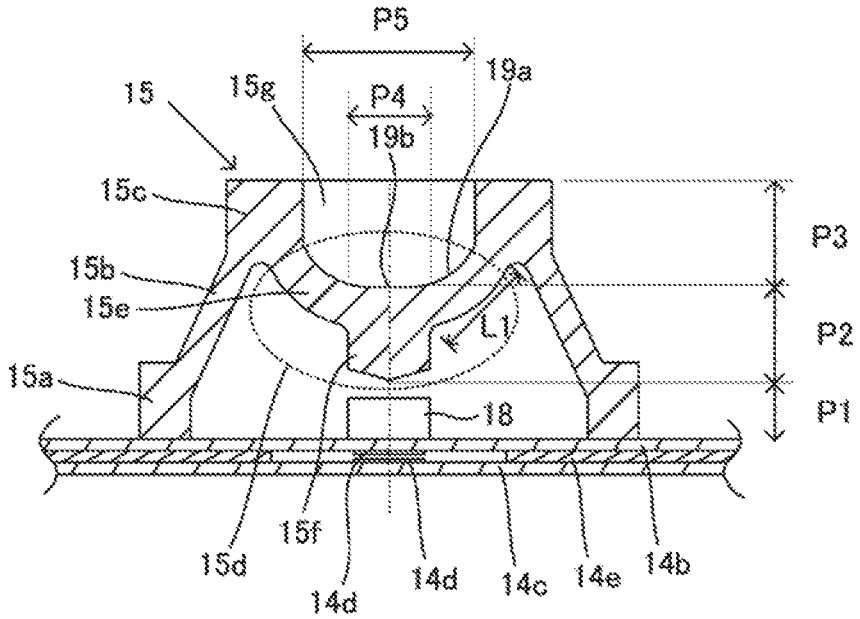
FIG. 2A is a cross-section diagram of a dome rubber according to a present embodiment.
Figure 2B:
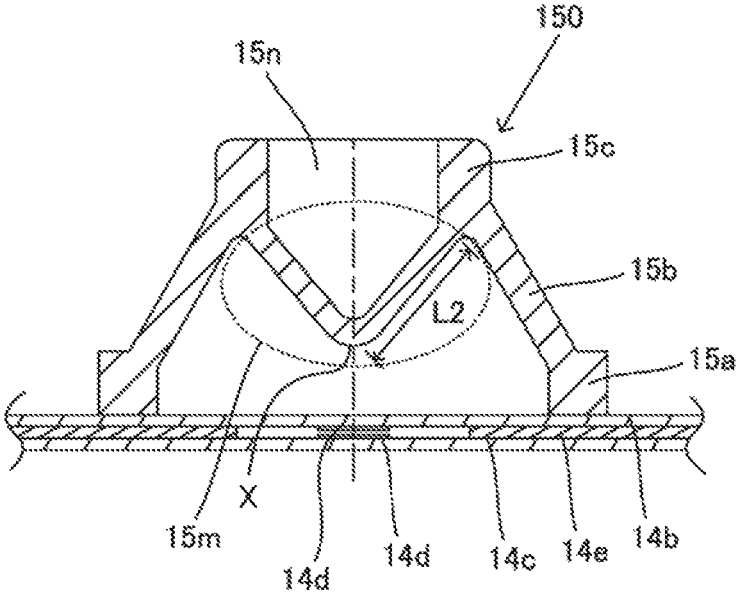
FIG. 2B is a cross-section diagram of a dome rubber according to a comparative example.

FIG. 1A is an exploded perspective view illustrating a key switch device according to a present embodiment. FIG. 1B is a diagram illustrating a computer including a keyboard on which a plurality of key switch devices are arranged. FIG. 2A is a cross-section diagram of a dome rubber according to a present embodiment. FIG. 2B is a cross-section diagram of a dome rubber according to a comparative example.

A key switch device 100 includes a key top 10 functioning as an operation member, two gear links 12*a* and 12*b*, a membrane sheet 14, and a support panel 17, as illustrated in FIG. 1A. On a keyboard 200, a plurality of key switch devices 100 are arranged, as illustrated in FIG. 1B. Here, in the keyboard 200 of FIG. 1B, the single membrane sheet 14 and the single support panel 17 corresponding to the plurality of key switch devices 100 are used.

The membrane sheet 14 includes sheet substrates 14*b* and 14*c*, a spacer 14*e* arranged between the sheet substrates 14*b* and 14*c*, and a pair of contacts 14*d* functioning as a switch, as illustrated in FIG. 2A. The sheet substrates 14*b* and 14*c* are separated via the spacer 14*e* by a given distance. The pair of contacts 14*d* are formed at positions of the sheet substrates 14*b* and 14*c* on which the spacer 14*e* is not provided, so as to be opposite to each other, respectively. A dome rubber 15 as a reaction force generating member is fixed on the membrane sheet 14.

The dome rubber 15 is a dome-shaped member composed of a rubber material by integral molding. The dome rubber 15 includes a ring-shaped base part 15*a*, an outer dome 15*b* as a first dome extending obliquely from the base part 15*a*, a cylindrical part 15*c* extending vertically upward from the outer dome 15*b*, and an inner dome 15*d* as a second dome extending downward from the cylindrical part 15*c*. The outer dome 15*b* elastically deforms according to a depression force. An upper end of the cylindrical part 15*c* contacts a rear surface of the key top 10.

A place surrounded by the base part 15*a*, the outer dome 15*b* and the inner dome 15*d* is a space, and an air hole 18 is formed on the base part 15*a*. The inner dome 15*d* includes a hemispherical bowl part 15*e* extending downward from the cylindrical part 15*c*, and a projection 15*f* projecting downward from the center of the bowl part 15*e*. Since the projection 15*f* is provided in the center of the bowl part 15*e*, the center of the bowl part 15*e* is thicker than an outer circumference of the bowl part 15*e*. Therefore, when the projection 15*f* is in contact with the membrane sheet 14 and the key top 10 is depressed, the bowl part 15*e* is deformed upward, but the projection 15*f* does not bend and does not cause the buckling deformation. In the present embodiment, the buckling deformation is deformation in which a load level decreases according to the increase in stroke. The cylindrical part 15*c* includes a recess 15*g* housing the inner dome 15*d* (i.e., the bowl part 15*e* which is deformed upward and the projection 15*f*).

A dome rubber 150 of a comparative example illustrated in FIG. 2B includes an inner dome 15*m* having an inverse cone shape. The cylindrical part 15*c* of the dome rubber 150 includes a recess 15*n* housing the inner dome 15*m*. The dome rubber 15 differs from the dome rubber 150 in the shapes of the inner dome and the recess, and the other configurations of the dome rubber 15 are the same as those of the dome rubber 150.

A length L1 of a deformable portion (i.e., a part from the cylindrical part 15*c* to the projection 15*f*) of the inner dome 15*d* in FIG. 2A is shorter than a length L2 of a deformable portion (i.e., a part from the cylindrical part 15*c* to an apex X) of the inner dome 15*m* in FIG. 2B.

In the case of FIG. 2B, since the length L2 is longer than the length L1, when the thicknesses of the left and right of the inner dome 15*m* are different due to molding, the dome rubber 150 is susceptible to uneven deformation. On the contrary, in the dome rubber 15 of FIG. 2A, since the projection 15*f* is provided in the center of the bowl part 15*e*, it is possible to shorten the length L1 of the deformable portion of the inner dome 15*d*, and therefore the dome rubber 15 is hardly affected by the uneven deformation.

With the increase in the stroke, the inner dome is housed in the recess while being tightly stretched. Therefore, a load applied to the deformable portion of the inner dome 15*m* having the inverted cone shape of FIG. 2B is large, and the product life of the dome rubber 150 may be shortened. Moreover, in the case of the dome rubber 150, when the key top 10 is depressed beyond a stroke end, the inner dome 15*m* is reversed and may not return to the shape of FIG. 2B. On the contrary, since the deformable portion of the inner dome 15*d* in FIG. 2A has a bowl shape, when the deformed portion is housed in the recess 15*g*, the load can be reduced and no reversal of the deformable portion occurs.

An upper surface 19*a* of the bowl part 15*e* of the inner dome 15*d* in FIG. 2A has a spherical shape, and in particular, an upper surface 19*b* of the bowl part 15*e* located above the projection 15*f* has a gentle spherical shape or planar shape. This is because, when the cross section of the upper surfaces 19*a* and 19*b* of the bowl part 15*e* has a V-shape of FIG. 2B, the inner dome 15*d* is easy to cause the buckling deformation and it is not possible to obtain a desired load displacement characteristic of the dome rubber 15.

A length P2 from the upper surface 19*b* of the bowl part 15*e* to an apex pf the projection 15*f* illustrated in FIG. 2A is shorter than a length P3 from the upper surface 19*b* of the bowl part 15*e* to an upper end of the cylindrical part 15*c*. Moreover, a horizontal length P4 of the upper surface 19*b* of the bowl part 15*e* is shorter than a length P5 of the inner diameter of the cylindrical part 15*c*. These are because of housing the inner dome 15*d* in the recess 15*g* to thereby ensure a longer stroke.

Returning to FIG. 1A, the support panel 17 is disposed under the key top 10 and the membrane sheet 14 is disposed between the key top 10 and the support panel 17. An upper surface of the support panel 17 is opposite to a lower surface of the membrane sheet 14. The support panel 17 includes four regulation parts 17*a* that regulate the movement in a vertical direction of shafts 12*c* of the gear links 12*a* and 12*b*. Each of the regulation parts 17*a* is vertically formed to the support panel 17, and includes an approximately rectangle hole 17*b* into which the shaft 12*c* moving in a horizontal direction is inserted. A part of the upper surface of the support panel 17 and the regulation parts 17*a* are exposed from holes 14*a* provided in the membrane sheet 14.

As illustrated in FIG. 1A, projections 12*e* are provided on apical parts 12*d* of the gear links 12*a* and 12*b* and are rotatably fixed to the rear surface of the key top 10. The shafts 12*c* are formed in the rear ends of the gear links 12*a* and 12*b*, and are inserted into holes 17*b* of the regulation parts 17*a*. Thereby, the gear links 12*a* and 12*b* are movably fixed to the support panel 17.

A first tooth 12*g* is provided on one of the apical parts 12*d* of the gear link 12*a* (i.e., the apical part 12*d* of a front side in FIG. 1A), and a second tooth 12*h* is provided on another one of the apical parts 12*d* (i.e., the apical part 12*d* of a back side in FIG. 1A). The first tooth 12*g* and the second tooth 12*h* are provided on the gear link 12*b*. The first tooth 12*g* of the gear link 12*a* engages with the second tooth 12*h* of the gear link 12*b*, and the second tooth 12*h* of the gear link 12*a* engages with the first tooth 12*g* of the gear link 12*b*. Thus, the pair of gear links 12*a* and 12*b* are coupled at the apical parts 12*d*, and can operate simultaneously with each other. Arm parts 12*f* extend from the apical parts 12*d* toward the shafts 12*c*.

When the key top 10 is not depressed (at the time of un-depressing), the two gear links 12*a* and 12*b* are assembled in the shape of a reverse V-character, and support the key top 10. When the key top 10 is depressed with an operator's finger (at the time of depression) for example, the rear surface of the key top 10 depresses the dome rubber 15. Thereby, the dome rubber 15 performs buckling deformation, the projection 15*f* of the inner dome 15*d* depresses the membrane sheet 14, and the contact 14*d* is turned on. When the finger is lifted from the key top 10, the key top 10 is pushed upwards by the elastic force in an upper direction of the outer dome 15*b* and the inner dome 15*d*. The rear ends of the gear links 12*a* and 12*b* are slid in the horizontal direction with depression of the key top 10. Then, the arm parts 12*f* fall down. Thus, the gear links 12*a* and 12*b* guide the key top 10 in the vertical direction while keeping the key top 10 horizontal.

In FIG. 1A, the two gear links 12*a* and 12*b* are assembled in the shape of the reverse V-character, and support the key top 10. However, the two gear links 12*a* and 12*b* may be assembled in the shape of a V-character.

Figure 3A:
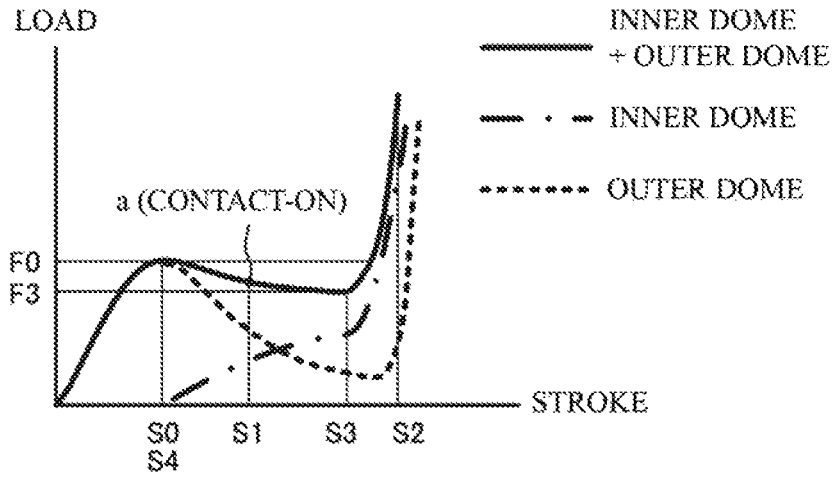
FIG. 3A is a diagram illustrating a load displacement characteristic of the dome rubber according to the present embodiment.
Figure 3B:
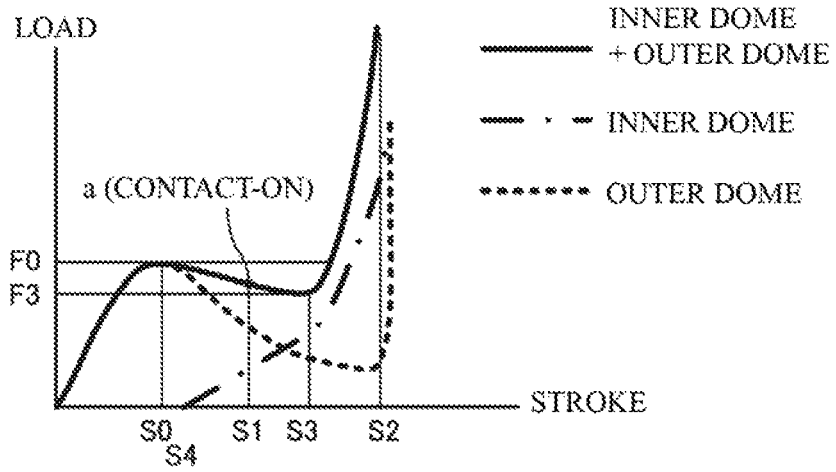
FIG. 3B is a diagram illustrating a load displacement characteristic of the dome rubber according to the comparative example.

Hereinafter, a description will be given of a relationship between a stroke S of the key top 10 (i.e., an amount of depression) and a load (i.e., a depression force) F. FIG. 3A is a diagram illustrating a load displacement characteristic of the dome rubber 15, and FIG. 3B is a diagram illustrating a load displacement characteristic of the dome rubber 150 according to the comparative example. Here, in FIGS. 3A and 3B, the stroke S is set to a horizontal axis, the load F is set to a vertical axis, and a point "a" of contact-ON is illustrated additionally. A code F0 indicates a peak load, and a code F3 indicates a bottom load which is a minimum load after a peak load. A code S0 indicates a stroke corresponding to the peak load F0. A code S1 indicates a stroke at the time of turning ON of the contact 14*d*. A code S2 indicates the stroke end. A code S3 indicates a stroke corresponding to the bottom load F3. A code S4 indicates a stroke when a lower end of the projection 15*f* or an apex X of the inner dome 15*m* is in contact with the membrane sheet 14.

In FIG. 3A, a dotted line indicates the load displacement characteristic of the outer dome 15*b*, an alternate long and short dash line indicates the load displacement characteristic of the inner dome 15*d*, and a solid line indicates the total of the load displacement characteristics of the outer dome 15*b* and the inner dome 15*d*, i.e., the load displacement characteristic of the dome rubber 15.

When the load F of the key top 10 increases from 0, the stroke S also increases from 0 with the increase in the load F, as illustrated in FIG. 3A. At this time, the outer dome 15*b* performs the elastic deformation, and the reaction force from the outer dome 15*b* acts on the key top 10. The load F rises until the load which acts on the dome rubber 15 reaches a buckling load (i.e., the load F0) of the dome rubber 15. When the load which acts on the dome rubber 15 reaches the buckling load, subsequently the load F decreases gently with the increase in the stroke S. A peak load F0 is obtained by the elastic buckling deformation of the dome rubber 15, and hence the operator can get a particular click feeling in a key touch operation.

In this case, a stroke S4 corresponds to an initial length P1 between the lower end of the projection 15*f* and the membrane sheet 14 (see FIG. 2A). This length P1 can be set by adjusting the length of the projection 15*f*. The stroke S4 can be changed by adjusting the length P1, and hence the stroke S1 of the key top 10 at the time of contact-ON can be changed. That is, by adjusting the length P1, the stroke S1 of the key top 10 at the time of contact-ON can be set arbitrarily.

In the present embodiment, the stroke S1 is set to a value that is larger than a stroke S0 in which the peak load F0 is generated, and that is smaller than a stroke S3 corresponding to the bottom load F3 (for example, a middle value between the strokes S0 and S3). Thereby, since the contact 14*d* is turned on in a reduction domain of the load F after the operator gets the click feeling, an operator's operation feeling sufficiently corresponds to the ON-operation of the contact 14*d*, and hence the operability of the key switch improves.

In FIG. 3A, the stroke S0 and the stroke S4 overlap with each other. That is, while the outer dome 15*b* reaches the buckling load (i.e., the peak load F0), the lower end of the projection 15*f* is in contact with the membrane sheet 14. However, the stroke S4 may be disposed slightly to the right of the stroke S0, as illustrated in FIG. 3B. In this case, after the outer dome 15*b* reaches the buckling load (i.e., the peak load F0), the apex of the projection 15*f* is in contact with the membrane sheet 14.

In a section between the stroke S0 corresponding to the peak load and the stroke S3 corresponding to the bottom load, i.e., a section where the load level reduces (hereinafter referred to as "a click section"), a load reduction amount of the outer dome 15*b* is slightly larger than that of the inner dome 15*d*. For this reason, in the click section, the load displacement characteristic of the dome rubber 15 (i.e., the solid line) gently reduces.

By the way, in the click section, the load displacement characteristic of the inner dome 15*d* of FIG. 3A (i.e., the alternate long and short dash line) gently increases, but the load displacement characteristic of the inner dome 15*m* of FIG. 3B (i.e., the alternate long and short dash line) linearly increases. That is, in the click section, the load displacement characteristic of the inner dome 15*d* of FIG. 3A is lowered in a load increase rate more than the load displacement characteristic of the inner dome 15*m* of FIG. 3B. This is because, since the inner dome 15*d* does not perform the buckling deformation but the deformation close to the buckling deformation, it is possible to lower the load increase rate for a given section.

Thus, since in the click section, the load displacement characteristic of the inner dome 15*d* of FIG. 3A is lowered in a load increase rate more than the load displacement characteristic of the inner dome 15*m* of FIG. 3B, the stroke S3 corresponding to the bottom load of FIG. 3A is greater than the stroke S3 of FIG. 3B, which can make the click section longer and obtain more comfortable operation feeling.

FIGS. 4A to 4D are diagrams illustrating transition states of the deformation of the dome rubber 15. FIGS. 4E to 4H are diagrams illustrating transition states of the deformation of the dome rubber 150.

Figure 4A:
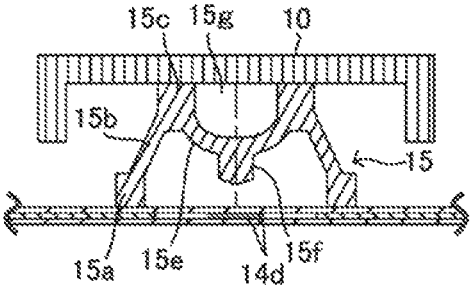
FIGS. 4A to 4D are diagrams illustrating transition states of the deformation of the dome rubber according to the present embodiment.

FIG. 4A illustrates a state of the dome rubber 15 when the load F is 0 and the stroke S is 0 in FIG. 3A. FIG. 4E illustrates a state of the dome rubber 150 when the load F is 0 and the stroke S is 0 in FIG. 3B.

Figure 4B:
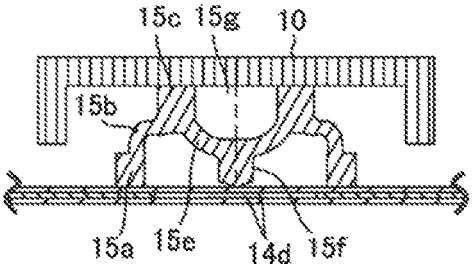

FIG. 4B illustrates a state of the dome rubber 15 when the load F is F0 and the stroke S is S0 and S4 in FIG. 3A. In FIG. 4B, the apex of the projection 15*f* is in contact with the membrane sheet 14 simultaneously with or immediately after the outer dome 15*b* performs the buckling deformation. FIG. 4F illustrates a state of the dome rubber 150 when the load F is F0 and the stroke S is S4 in FIG. 3B. In FIG. 4F, the apex X of the inner dome 15*m* is in contact with the membrane sheet 14 immediately after the outer dome 15*b* performs the buckling deformation.

Figure 4C:
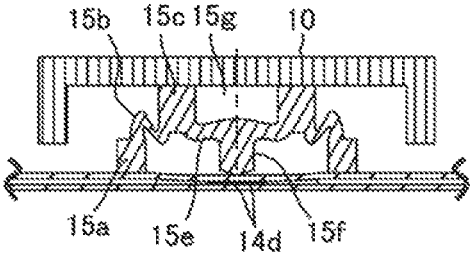

FIG. 4C illustrates a state of the dome rubber 15 when the stroke S is S1 in FIG. 3A. The outer dome 15*b* continues the buckling deformation, and the load displacement characteristic of the outer dome 15*b* has a tendency to decrease. The inner dome 15*d* depresses the membrane sheet 14, and the contact 14*d* is turned on. Moreover, the bowl part 15*e* of the inner dome 15*d* deforms so that the inner dome 15*d* is housed in the recess 15*g*. The load displacement characteristic of the inner dome 15*d* has a tendency to increase. The total of the load displacement characteristics of the outer dome 15*b* and the inner dome 15*d* tends to decrease.

Figure 4D:
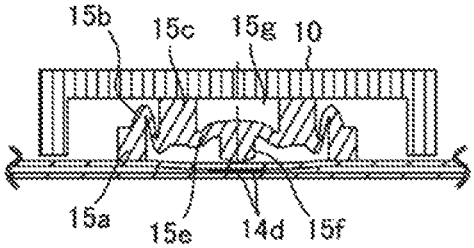
Figure 4E:
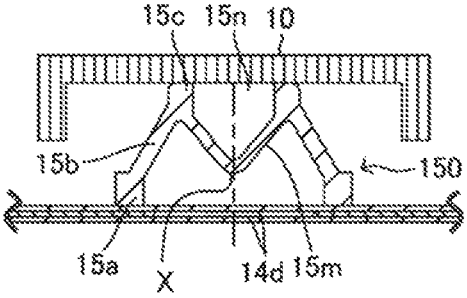
FIGS. 4E to 4H are diagrams illustrating transition states of the deformation of the dome rubber according to the comparative example.
Figure 4F:
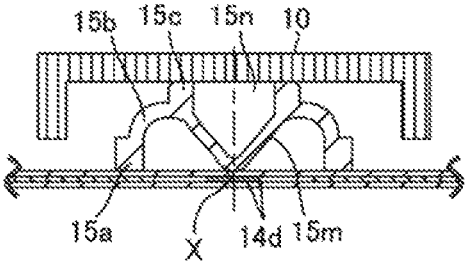
Figure 4G:
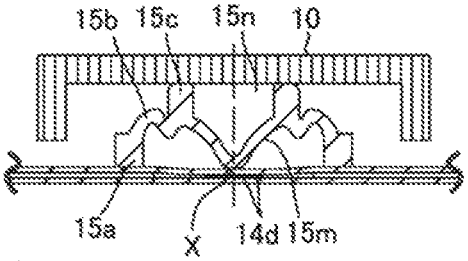

FIG. 4G illustrates a state of the dome rubber 150 when the stroke S is S1 in FIG. 3B. The outer dome 15*b* continues the buckling deformation, and the load displacement characteristic of the outer dome 15*b* tends to decrease. The inner dome 15*m* depresses the membrane sheet 14, and the contact 14*d* is turned on. Moreover, the inner dome 15*m* deforms so that the inner dome 15*m* is housed in the recess 15*n*. The load displacement characteristic of the inner dome 15*m* is a tendency to increase linearly. The total of the load displacement characteristics of the outer dome 15*b* and the inner dome 15*m* tends to decrease.

FIG. 4D illustrates a state of the dome rubber 15 when the load F is F3 and the stroke S is S3 in FIG. 3A. In FIG. 4D, the deformable state of the inner dome 15*d* is finished, and then the load displacement characteristic of the inner dome 15*d* is a tendency to increase significantly. In FIG. 4D, the click section is finished.

Figure 4H:
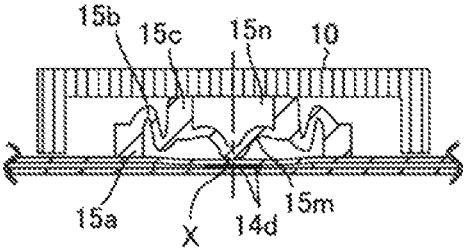

FIG. 4H illustrates a state of the dome rubber 150 when the load F is F3 and the stroke S is S3 in FIG. 3B. In FIG. 4H, the deformable state of the inner dome 15*m* is finished, and then the load displacement characteristic of the inner dome 15*m* is the tendency to increase significantly. In FIG. 4H, the click section is finished.

Figure 5A:
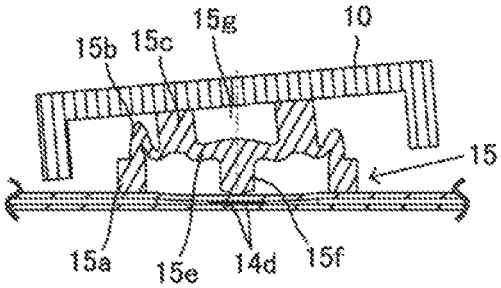
FIG. 5A is a diagram illustrating a deformation state of the dome rubber according to the present embodiment when the key top is inclined.
Figure 5B:
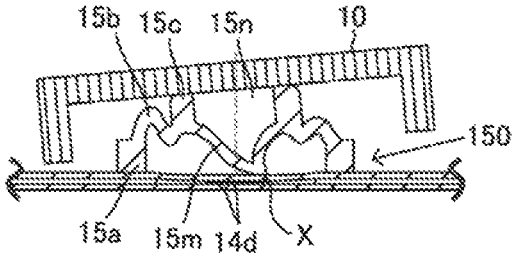
FIG. 5B is a diagram illustrating a deformation state of the dome rubber according to the comparative example when the key top has been inclined and an inner dome has caused buckling deformation.
Figure 5C:
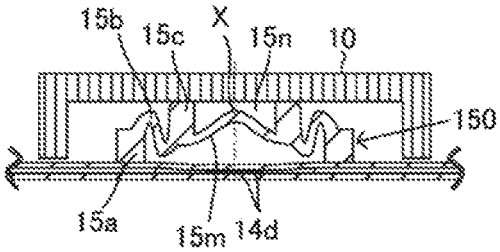
FIG. 5C is a diagram illustrating a deformation state of the dome rubber according to the comparative example when the inner dome has inverted.

FIG. 5A is a diagram illustrating a deformation state of the dome rubber 15 according to the present embodiment when the key top 10 is inclined. FIG. 5B is a diagram illustrating a deformation state of the dome rubber 150 when the key top 10 has been inclined and the inner dome 15*m* has caused buckling deformation. FIG. 5C is a diagram illustrating a deformation state of the dome rubber 150 when the inner dome 15*m* has inverted.

When a corner of the key top 10 is depressed and the key top 10 is tilted, the load is not applied evenly left and right to the outer dome 15*b* and the inner dome 15*m* of the dome rubber 150, and hence the inner dome 15*m* may cause the buckling deformation as illustrated in FIG. 5B. When the key top 10 is depressed beyond the stroke end, the inner dome 15*m* of the dome rubber 150 is reversed as illustrated in FIG. 5C and may not return to an original shape.

On the contrary, in the dome rubber 15, even when the corner of the key top 10 is depressed and the key top 10 is tilted, since the projection 15*f* is provided in the center of the bowl part 15*e*, the projection 15*f* serves as a fulcrum without causing the buckling deformation and depresses the contact 14*d* as illustrated in FIG. 5A. Therefore, the dome rubber 15 can depress the contact 14*d* without being affected by the inclination of the key top 10.

As described above, the dome rubber 15 includes: the outer dome 15*b* that gives the reaction force to the key top 10 according to the depression of the key top 10; and the inner dome 15*d* that is formed integrally with the outer dome 15*b*, and includes the hemispherical bowl part 15*e* disposed inside the outer dome 15*b*, and the projection 15*f* extending downward from the center of the bowl part 15*e* and depressing the contact 14*d* disposed below the key top 10. Thereby, even when the corner of the key top 10 is depressed and the key top 10 is tilted, since the projection 15*f* serves as the fulcrum and depresses the contact 14*d*, the contact 14*d* is turned on in the process of decreasing a depression load of the key top 10, which makes the operation feeling and the contact depression operation sufficiently correspond to each other.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A reaction force generating member comprising:

a first dome that gives a reaction force to an operation member according to a depression of the operation member; and a second dome that includes a hemispherical bowl part disposed inside the first dome, and a projection projecting downward from a center of the bowl part and depressing a switch disposed below the operation member, wherein the first dome has a first load displacement characteristic in which a depression load of the operation member increases until the first dome performs buckling deformation according to the depression of the operation member, the depression load of the operation member reaches a peak load, and the depression load of the operation member decreases after the buckling deformation, the second dome has a second load displacement characteristic in which the depression load of the operation member nonlinearly increases according to a depression amount of the operation member, and when the depression load of the operation member in a total of the first and the second load displacement characteristics of the first dome and the second dome decreases and before the depression load of the operation member reaches a bottom load which is a minimum load after the peak load, the projection turns on the switch, and wherein the second load displacement characteristic is lower in a load increase rate than a third load displacement characteristic in which the depression load linearly increases according to the depression amount of the operation member.

2. The reaction force generating member as claimed in claim 1, wherein the first dome performs buckling deformation, and the second dome never performs the buckling deformation.

3. The reaction force generating member as claimed in claim 2, wherein the projection is in contact with the switch simultaneously with or immediately after the first dome performs the buckling deformation.

4. The reaction force generating member as claimed in claim 1, wherein while the depression load of the operating member reaches the peak load from a load turning on the switch, the second load displacement characteristic is lower in the load increase rate than the third load displacement characteristic.

5. A key switch device comprising:

an operation member to be depressed;

a switch disposed under the operation member; and a reaction force generating member, provided between the operation member and the switch, including:

a first dome that gives a reaction force to the operation member according to a depression of the operation member; and a second dome that includes a hemispherical bowl part disposed inside the first dome, and a projection projecting downward from a center of the bowl part and depressing the switch disposed below the operation member, wherein the switch is turned on when a stroke of the operation member is larger than a first stroke corresponding to a peak load and smaller than a second stroke corresponding to a bottom load after the peak load, and wherein the second dome has a first load displacement characteristic in which a depression load of the operation member nonlinearly increases according to a depression amount of the operation member, the first load displacement characteristic being lower in a load increase rate than a second load displacement characteristic in which the depression load linearly increases according to the depression amount of the operation member.

6. The key switch device as claimed in claim 5, wherein the projection is in contact with the switch simultaneously with or immediately after the stroke of the operation member reaches the first stroke.

7. The key switch device as claimed in claim 5, wherein while the operating member is pressed from a third stroke for turning the switch on to the second stroke, the first load displacement characteristic is lower in the load increase rate than the second load displacement characteristic.

8. A key switch device comprising:

a depressable operation member;

a switch configured to be activated by a depression of the operation member; and a reaction force generating member provided between the operation member and the switch, and including:

an outer dome configured to provide a reaction force to the operation member according to the depression of the operation member; and an inner dome disposed inside the outer dome, having a bowl shape, and having a first load displacement characteristic in which a depression load of the operation member nonlinearly increases according to an amount of the depression of the operation member, wherein the first load displacement characteristic has a lower load increase rate than a second load displacement characteristic in which the depression load linearly increases according to the amount of the depression of the operation member because the inner dome does not perform a buckling deformation but rather a deformation close to the buckling deformation, to lower the load increase rate such that a stroke corresponding to a bottom load is increased to make a click section of the depressable operation member longer and provide a more comfortable operation feeling relative to the second load displacement characteristic.

* * * * *